United States Patent [19]

Cookson et al.

[11] Patent Number: 4,458,101

[45] Date of Patent: Jul. 3, 1984

[54] GAS-INSULATED EPOXY BUSHING HAVING AN INTERNAL THROAT SHIELD AND AN EMBEDDED GROUND SHIELD

[75] Inventors: Alan H. Cookson, Pittsburgh; Michael Yatsko, Monroeville; both of Pa.

[73] Assignee: Westinghouse Electric Corp., Pittsburgh, Pa.

[21] Appl. No.: 366,626

[22] Filed: Apr. 8, 1982

[51] Int. Cl.[3] ..... H01B 17/26; H01B 17/36

[52] U.S. Cl. ..... 174/31 R; 174/142

[58] Field of Search ..... 174/19, 31 R, 142, 143

[56] References Cited

U.S. PATENT DOCUMENTS

| | | | |
|---|---|---|---|
| 1,253,736 | 1/1918 | Sieber | 174/142 |
| 1,350,925 | 8/1920 | Faccioli | 174/31 R X |
| 1,526,023 | 2/1925 | Steinberger | 174/142 X |
| 2,945,913 | 7/1960 | Conangla | 174/73 R |
| 3,018,318 | 1/1962 | Franklin | 174/73 R |
| 3,312,776 | 4/1967 | Deck et al. | 174/143 |
| 3,602,629 | 8/1971 | Friedrich et al. | 174/142 X |
| 4,166,194 | 8/1979 | Bolin | 174/142 X |
| 4,272,642 | 6/1981 | Classon | 174/142 X |
| 4,296,274 | 10/1981 | Cookson | 174/142 |

FOREIGN PATENT DOCUMENTS

| | | | |
|---|---|---|---|
| 46-15815 | 4/1971 | Japan | 174/143 |
| 953642 | 2/1964 | United Kingdom | 174/143 |

*Primary Examiner*—Laramie E. Askin

*Attorney, Agent, or Firm*—M. S. Yatsko

[57] ABSTRACT

A gas-insulated bushing comprises an elongated epoxy insulating shell having a grounded mounting plate secured at one end thereof and an electrical connection terminal secured at the other end thereof. An inner conductor at high voltage is disposed within the shell and is secured to the terminal, with an insulating gas electrically insulating the inner conductor from the shell. An electrically grounded ground shield is cast into the epoxy shell and extends outwardly to physically and electrically contact the grounded mounting plate. A throat shield is secured to the mounting plate and extends longitudinally into the interior of the shell. The dual shield system disclosed functions to inhibit puncturing of the insulating shell, with a resultant loss of insulating gas, in the event of either internal or external flashovers.

5 Claims, 2 Drawing Figures

GAS-INSULATED EPOXY BUSHING HAVING AN INTERNAL THROAT SHIELD AND AN EMBEDDED GROUND SHIELD

BACKGROUND OF THE INVENTION

This invention relates generally to electrical apparatus, and more particularly to a gas-insulated epoxy bushing which has a ground shield cast into the base of the bushing wall.

Air-to-gas bushings have typically been utilized on conventional gas-insulated equipment such as circuit breakers or compressed gas-insulated transmission lines. Such conventional air-to-gas bushings typically comprise an outer insulating shell of either procelain or an epoxy material, with a centrally disposed conductor extending down through the center of the housing. Stress control shields are utilized to control stresses along the housing, and generally are internal, concentric throat shields disposed within the hollow shell, and occasionally external grounded shields are also utilized. The interior of the housing is filled with an insulating gas, typical of which is sulfur hexafluoride gas at a pressure of 50 lb./sq. in. gauge.

The operation of the typical procelain gas bushing has been satisfactory, but there are some disadvantages associated with it. The major disadvantage is that in the event of a puncture, the procelain shatters. The usual failure location is associated with the top of the internally disposed throat shield. The electric field here on the side facing the air is high, and as a consequence there are often intense corona discharges along the procelain surface in the air. Occasionally, flashover occurs along the surface of the procelain in the air, then punctures through the procelain shell to the top of the internal throat shield.

In the design of the bushing, it is necessary to have gas clearance between the conductor and the throat shield, and the dimensions are such as to prevent a breakdown in the gas. In addition, clearance is required between the edge of the throat shield and the inside surface of the procelain, so that there are no discharges from the top of the throat shield to the procelain.

Designs utilizing an epoxy shell instead of the procelain shell generally utilize the same type of stress control means as heretofore described. Additionally, an external toroid at the top of the bushing is occasionally utilized. In the event of a flashover failure, there is still a tendency for the breakdown channel to go from the air side through the epoxy to the top of the internal throat shield. Even if the epoxy is formulated so as not to shatter, there is still a puncture through the epoxy for the insulating gas to leak out.

SUMMARY OF THE INVENTION

In accordance with this invention, a gas-insulated bushing is comprised of an elongated hollow epoxy insulating shell having an electrically conducting grounded mounting ring secured to one end thereof, and terminal means secured to the other end thereof. An elongated conductor is disposed within, but spaced apart from, the epoxy shell, and is electrically connected to the terminal means. An insulating gas is disposed within the shell and electrically insulates the conductor from the shell. A ground shield is cast within the epoxy shell wall adjacent to, and contacting, the grounded mounting ring, so that the ground shield is also electrically grounded. The ground shield thus functions to control the electrical stresses on the epoxy shell while minimizing the possibility of a puncture through the shell.

BRIEF DESCRIPTION OF THE DRAWINGS

Reference is now made to the description of the preferred embodiment, illustrated in the accompanying drawings, in which.

DESCRIPTION OF THE PREFERRED EMBODIMENTS

Figure 1:
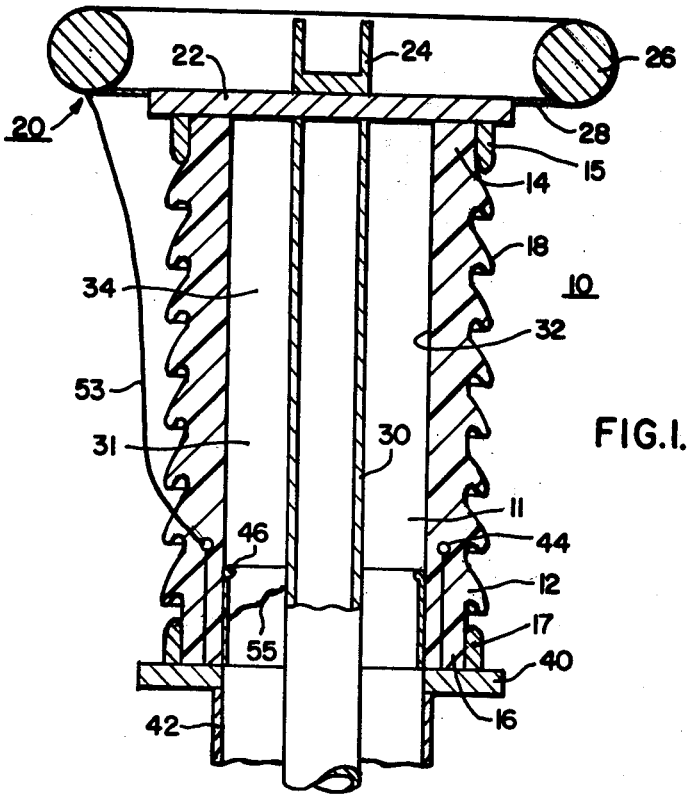
FIG. 1 is a sectional view illustrating the bushing of this invention.

The gas-insulated bushing 10 illustrated in FIG. 1 comprises an elongated, hollow epoxy insulating shell 12 in the form of a cylinder having a terminal end 14 and a base end 16 at the longitudinal ends thereof. As can be readily appreciated, the insulating shell 12 has a plurality of skirts 18 along the exterior surface thereof.

Secured to the terminal end 14 of the shell 12 are terminal means 20 for connecting to an external overhead transmission line (not shown). The terminal means 20 comprises the metallic, electrically conducting end cap 22 which is secured to the top flange 15 by means such as bolts (not shown) which in turn is secured to the shell end 14 by means such as a cement (not shown), and the terminal connector 24 which is physically secured to the end cap 22 and in electrical contact therewith. If desired, an electrically conducting toroid 26 may be disposed externally of the shell 12 in the vicinity of the terminal end 14, with the toroid 26 being held by the metallic supports 28 which also provide electrical connection between the toroid 26 and the end cap 22.

Disposed within the interior 11 of the hollow cylindrical shell 12 is an elongated conductor 30. The conductor 30 is coaxially disposed within the shell 12, and is spaced apart therefrom. Filling the space 31 between the conductor 30 and the interior surface 32 of the epoxy shell 12 is an electrically insulating gas 34 such as sulfur hexafluoride at pressures of, for example, 50 lb./sq. in. gauge. The insulating gas 34 functions to electrically insulate the high voltage inner conductor 30 from the insulating shell 12. The conductor 30 is physically secured to, and electrically contacts, the end cap 22, which also provides a means for physically supporting the conductor 30.

Secured to the base end 16 of the shell 12, by means such as a cement (not shown), is an electrically conducting flange 17. The base plate 40 is, in turn, bolted to the flange 17. The plate 40 would, in turn, then be connected to the electrically grounded outer enclosure of the gas-insulated apparatus to which the bushing 10 would be connected and thus the plate 40 would likewise be electrically grounded. As shown in FIG. 1, the mounting ring 40 could be connected, for example, to the outer sheath 42 of a compressed gas insulated transmission line.

As can be appreciated by those skilled in the art, the terminal end 14 of the insulating shell 12 is connected to the live, high-voltage inner conductor 30, while the base end 16 of the shell 12 is in contact with the grounded mounting plate 40. As a result, electrical field gradients occur along the longitudinal length of the epoxy shell 12. The most highly stressed region on the epoxy shell 12 occurs at the base end 16 wherein the shell 12 contacts the grounded mounting plate 40. To relieve the electric stresses across the shell 12 at this location, an electric field modifying ground shield 44 is utilized. The ground shield 44 is cast in, or embedded within, the shell wall adjacent the bottom end 16. The ground shield 44 extends longitudinally downwardly and outwardly to be electrically in contact with the grounded mounting plate 40. In this manner, the ground shield 44 is electrically at ground potential. By being so disposed, the ground shield 44 functions to distribute the high electric stresses over a greater longitudinal length of the epoxy shell 12.

A throat shield 46, of an electrically conducting material, may be physically and electrically secured to the mounting plate 40 and extend longitudinally into the interior 11 of the shell 12. The throat shield 46 is spaced apart from the conductor 30. However, to minimize the size of the shell 12 required, and because of the existence of the embedded ground shield 44, the throat shield 46 may be disposed so as to physically contact the interior surface 32 of the shell 12. As can be seen, the embedded ground shield 44 extends longitudinally outwardly from the mounting ring 40 towards the terminal end 14 a greater distance than does the throat shield 46.

The presence of the ground shield 44 cast within the epoxy shell 12 functions to provide an improved bushing 10 in that the bushing 10 is less susceptible to failure due to a flashover failure. If, for example, a flashover occurs along the exterior of the shell 12, as for example from the toroid 26, the flashover arc 53, which is attempting to get to ground electrical potential, would burn through the epoxy shell 12 to the ground shield 44, which is at ground potential. However, this burn-through would not extend all the way through the wall thickness of the shell 12 to the enter within the interior 11 thereof, thereby permitting the escape of the insulating gas 34. Rather, because the ground shield 44 is disposed within the wall thickness of the shell 12, the arc 53 would only travel part way through the shell wall to the ground shield 44, and the interior surface 32 of the shell 12 would remain intact.

Figure 2:
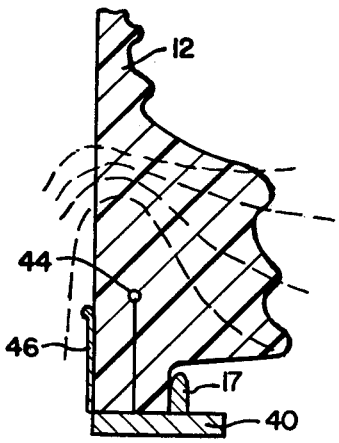
FIG. 2 is a sectional view illustrating a detailed modification of a portion of the bushing of FIG. 1.

As shown in FIG. 2, it may be desirable to increase the wall thickness of the shell 12 where the ground shield 44 is embedded. By increasing the wall thickness at this location, better control of the field on the air side of the shell 12 is achieved, with a resulting lower field on the epoxy surface in the air. Additionally, the use of such additional wall thickness provides greater insurance that a flashover and discharge will not completely puncture through the epoxy shell 12.

The use of the internally disposed throat shield 46 provides advantages in that flashovers from the inner conductor 30 to the shell 12 will not puncture the epoxy, since the flashovers will instead traverse, as at 55, to the throat shield 46. In other words, instead of a flashover from the inner conductor 30 going to the ground shield 44, the flashover 55 will go to the grounded throat shield 46. This therefore provides double insurance that the bushing 10 will not fail in the unlikely event of a flashover.

Since no stress occurs between the throat shield 46 and the interior surface 32 of the shell 12, because of the presence of the embedded ground shield 44, the throat shield 46 can be placed in physical contact with the interior surface 32 of the shell 12. By being so placed, the presence of the internal throat shield 46 does not require an increase in the diameter size of the shell 12.

The dual shield system utilized with the bushing 10 of this invention offers an efficient design which can be used with cast epoxy to reduce the inside diameter and overall length of the bushing 10 as compared with the prior art bushing. The cast-in ground shield 44 acts to control the voltage distribution on the external side of the shell 12 and acts as a collector should an air flashover attempt to enter the base of the bushing 12. The internally disposed, grounded throat shield 46 functions to prevent internal flashovers from puncturing the epoxy shell 12 from the inside, while not requiring an increased diameter of the shell 12. Furthermore, by utilizing the throat shield 46, the volume of epoxy at high stress at the ground shield 44 is much smaller than if the ground shield 44 alone were used; that is, the epoxy volume between the ground shield 44 and the throat shield 46 is at zero stress.

We claim as our invention:

1. A gas-insulated bushing comprising:

an elongated, hollow epoxy insulating shell having first and second longitudinal ends and a wall thickness;

an electrically conducting grounded mounting plate secured to said shell first end;

an elongated conductor centrally disposed within, and spaced-apart from, said shell;

terminal means secured to said shell second end and electrically connected to said conductor;

an insulating gas disposed within said shell and electrically insulating said conductor from said shell;

a ground shield cast within said shell wall adjacent said shell first end and extending longitudinally outward to contact said mounting plate, said ground shield being electrically grounded; and a throat shield secured to said mounting plate and extending longitudinally into the interior of said shell, said throat shield being electrically grounded and physically contacting the interior surface of said shell.

2. A gas-insulated bushing comprising:

a cylindrical epoxy insulating shell having first and second longitudinal ends and a wall thickness, said shell having a plurality of skirts along the exterior surface thereof;

an electrically conducting mounting plate at ground potential secured to said shell first end;

terminal means secured to said shell second end;

an elongated conductor coaxially disposed within said shell and secured to said terminal means, said conductor being spaced-apart from said shell;

an insulating gas disposed within said shell and electrically insulating said conductor from said shell;

a ground shield embedded within said shell wall adjacent said first end and extending longitudinally outwardly to contact said mounting plate; and a throat shield secured to said mounting plate and extending longitudinally into the interior of said shell spaced-apart from said conductor;

said throat shield physically contacting the interior surface of said shell.

3. A gas-insulated bushing according to claims 1 or 2 including an electrically conducting toroid disposed externally of said shell in the vicinity of said shell second end and electrically connected to said terminal means.

4. A gas-insulated bushing according to claims 1 or 2 wherein the wall thickness of said shell adjacent said ground shield is substantially the same as the wall thickness of the remainder of said shell.

5. A gas-insulated bushing according to claims 1 or 2 wherein said ground shield extends longitudinally farther towards said shell second end than said throat shield.

* * * * *